United States Patent [19]

Lambert, Jr. et al.

[11] 4,349,192

[45] Sep. 14, 1982

[54] COUNTERBALANCED WEIGHT SYSTEM

[76] Inventors: Lloyd J. Lambert, Jr.; Lloyd J. Lambert, Sr., both of 1538 College Ave., South Houston, Tex. 77587

[21] Appl. No.: 103,895

[22] Filed: Dec. 17, 1979

[51] Int. Cl.[3] ..... A63B 21/06

[52] U.S. Cl. ..... 272/118

[58] Field of Search ..... 273/93, 116, 117, 118, 273/122, 123, 134, 144, DIG. 4; 73/379

[56] References Cited

U.S. PATENT DOCUMENTS

| | | | |
|---|---|---|---|
| 2,387,966 | 10/1945 | Zander | 272/116 R |
| 3,746,338 | 7/1973 | Proctor | 272/118 |
| 3,807,728 | 4/1974 | Chillier | 272/118 |
| 3,971,555 | 7/1976 | Mahnke | 272/118 |
| 4,010,947 | 3/1977 | Lambert | 272/118 |
| 4,199,139 | 4/1980 | Mahnke et al. | 272/118 |
| 4,240,626 | 12/1980 | Lambert | 272/118 |

*Primary Examiner*—Richard J. Apley

*Attorney, Agent, or Firm*—Victor J. Evans & Co.

[57] ABSTRACT

Disclosed herein is a counterbalance weight system for use with exercising machines in order to negate the weight that is intrinsic to a weight lifting structure, so as to provide a true indication of the amount of work being done. The machine is defined by a framework which supports a plurality of weights the magnitude of which is selectively adjustable, an area to accommodate a user so as to lift the weights, and counterbalance weights operatively connected and opposing the preceeding structure so that the weight of the associated hardware necessary to perform the exercise is effectively cancelled out, and the weights lifted and selectable are solely that which constitutes the work of the exercise.

6 Claims, 9 Drawing Figures

FIG 7
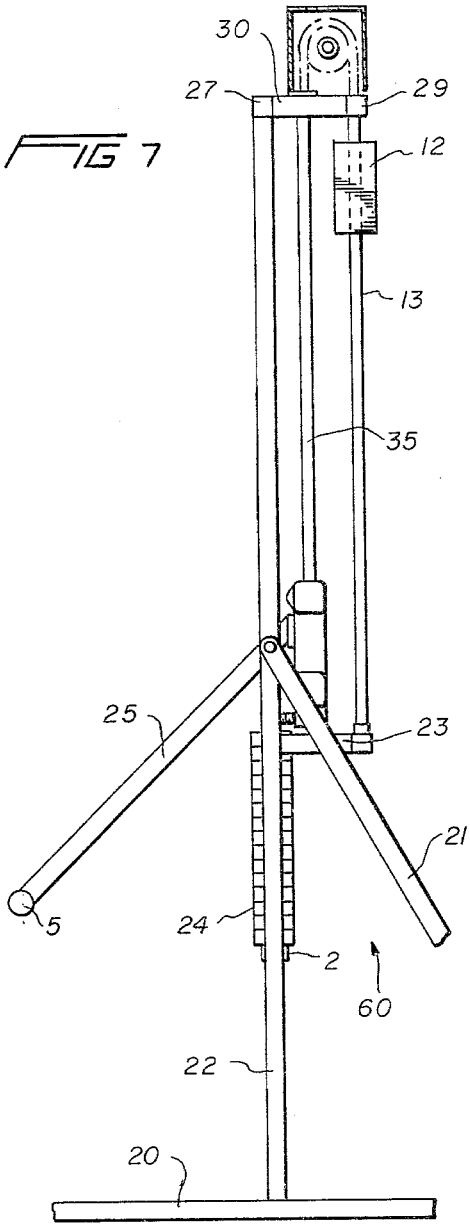
FIG 8
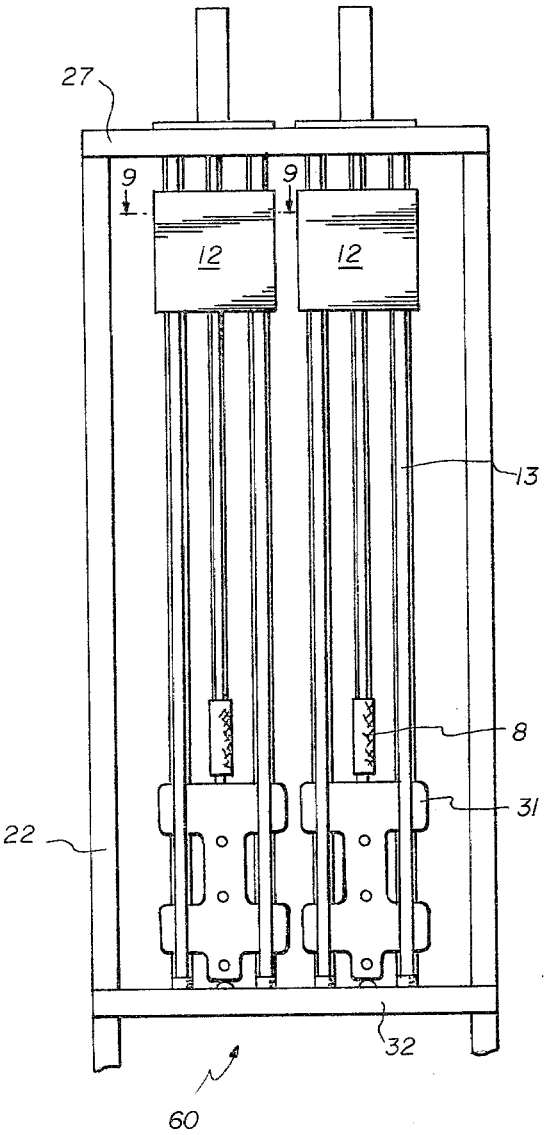
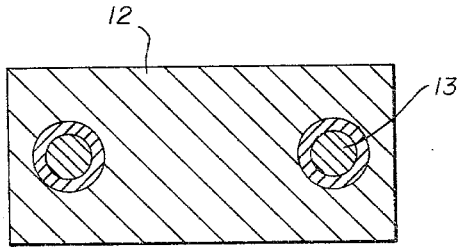
FIG 9

COUNTERBALANCED WEIGHT SYSTEM

BACKGROUND OF THE INVENTION

Weight lifting has developed into an exacting science in which the criteria for evaluating the effectiveness of any particular machine includes the following concepts; the safety of the machine for the user, the machine's ability to isolate the muscles to be worked on, and a standard by which the work done against a machine can be objectively known so as to form a basis for comparison or charting improvement, etc.

To these goals, the art and science of weight lifting equipment has made considerable inroads, but the ability to compare relative performances from one machine to the next are difficult to make simply because each type of machine has its own initialized weight quantum defined by at least the weight of the bar against which the exercise is done. Typically, the minimum weight quantum that is encountered when the machine is set at a 0 weight selection is 40 pounds, and it should be appreciated that for certain exercises and indeed for women or children this initial weight quantum maybe excessive to the extent that this particular machine is beyond their scope.

OBJECTS AND SUMMARY OF THE INVENTION

Accordingly, this invention has as a primary object the means by which the incidental hardware which defines the minimum weight quantum can be negated.

A corollary and concomitant objective contemplates providing a machine in which the minimal amount of work which can be done on the machine is not dictated by the weight of the necessary hardware but rather the magnitude of a single weight plate, typically 5 or 10 pounds.

A further object of the ensuing invention provides such a machine which does not compromise the safety on the machine to the user, but rather enhances same.

A further objective provides a machine which is durable in construction and easy to use.

These and other objects will be made manifest when considering the following detailed specification and drawing figures.

BRIEF DESCRIPTION OF THE DRAWINGS

FIG. 7 provides a perspective view of a second embodiment according to the present invention;

FIG. 8 is a side view of that which is shown in FIG. 7; and

FIG. 9 details a back view of that which is shown in FIG. 7.

DESCRIPTION OF THE PREFERRED EMBODIMENT

Figure 1:
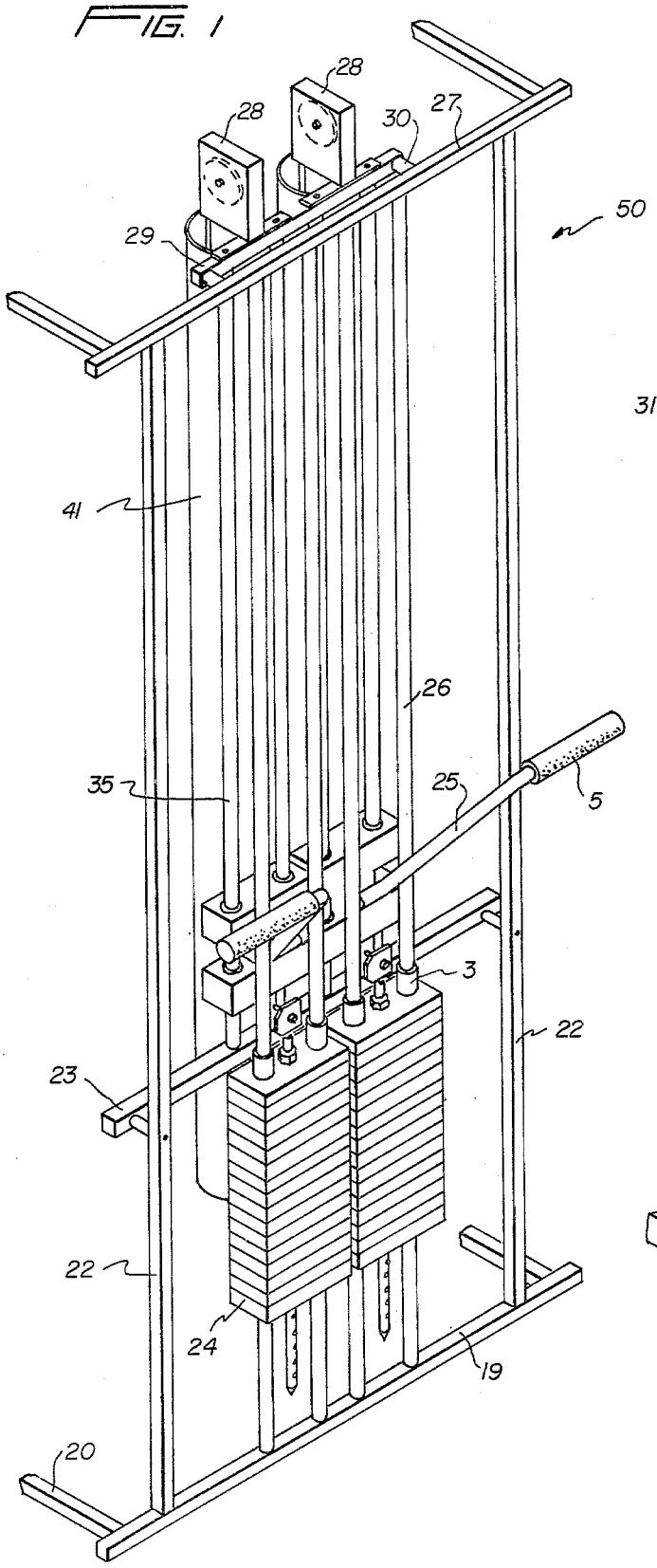
FIG. 1 is a perspective view of one form of the invention.
Figure 2:
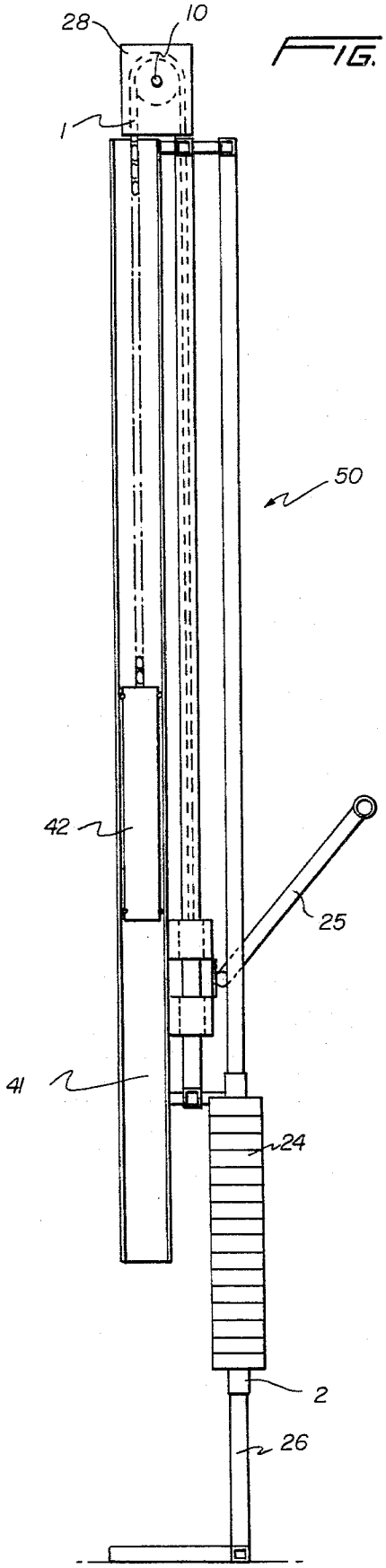
FIG. 2 is a side view thereof.

Referring to the reference drawings now, wherein like reference numerals refer to like parts throughout the several drawings, reference numeral 50 is directed to the apparatus according to the present invention as shown in FIGS. 1 and 2, while reference numeral 60 details the structure associated with the second form FIGS. 7–9 of the invention. Parts common to both machines however will be discussed first for the sake of simplicity and clarity, and the distinctions between the two machines will be enumerated thereafter.

Each machine is provided with a framework which serves to support the weight structure and the associated counterbalance weights, and the support framework is defined by parallel base members 20, interconnecting cross bar 19, and diagonal braces 21, as seen in FIG. 7, which serve to support vertical upstanding rod members 22, a pair of which are spaced apart and straddle both sides of the machine so that the vertical upstanding rods 22 and the base are provided with a stable structure. The top terminus of vertical rod members 22 is provided with a cross bar 27 interconnecting these two rods, and extending to the back of the machine a U-shaped frame element defined by reference numerals 29 and 30 serve to support the portion of the counterbalance weight system to be discussed hereinafter. Medially disposed along the vertical rod 22, a second U-shaped support bracket 23 provides support for the lower portion of the counterbalanced weight.

A horizontally planar bench may be provided if so desired. In this instance, one of its support bases is interconnected to the cross bar 19 through parallel spaced apart support base frames. Extending between the upstanding rods 22 and the top cross bar 27 and the bottom cross bar 19, four parallel weight rods 26 are provided, and slidably disposed on each pair thereof are a plurality of weights 24 which nest on these rods by means of brass bushings 3 so as to reduce friction. The lower most weight of these weights 24 are stopped from negative vertical displacement by means of rubber washers (FIGS. 2, 7) which are firmly affixed on the weight supports 26 in any manner well known in the art.

Each set of weights is provided with selector pins so as to adjust the magnitude of the weight to be worked against, and the selector pin engages a rod 37 (FIG. 3) having a plurality of holes thereon which are caused to register with corresponding holes within the weights 24.

Figure 3:
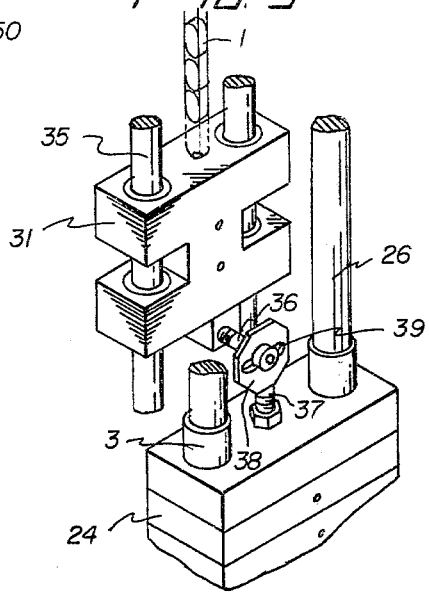
FIG. 3 provides a detailed structure of the interconnection between the weights to be selected and their transferral to a block mechanism which is attached to the bar exercise apparatus that the user engages as well as a trackway associated therewith.

The top terminus of rod 37 is provided with a substantially octogonal terminus 38 having a hole on the face thereof in which a pin 36 having an expanded portion thereon can engage. This octogonal terminus 38 and the pin 36 are firmly affixed by means of a cotter type link 39 as shown in FIG. 3, and the pin 36 provides a connection between the weights and a pair of I-shaped guides 31. These guides 31 by means of bearings 11 are slidably disposed on guide rods 35 and it is to be noted that four of these guide rods are provided which attach to a portion of cross bar 27. At the bottom extremity, they are supported by lower U-shaped support bracket 23.

Each I-shaped guide has firmly fastened thereto a handle 25 which extends outwardly away from the machine towards the front and thereafter flairs outwardly to form handle members 5. In FIG. 7 the handles are shown to cant downwardly, and in FIG. 1 and 2 they are shown to cant upwardly, and it is therefore to be appreciated that their angulation relative to the I-shaped guide can vary but once oriented at the factory are fixed in place.

Figure 5:
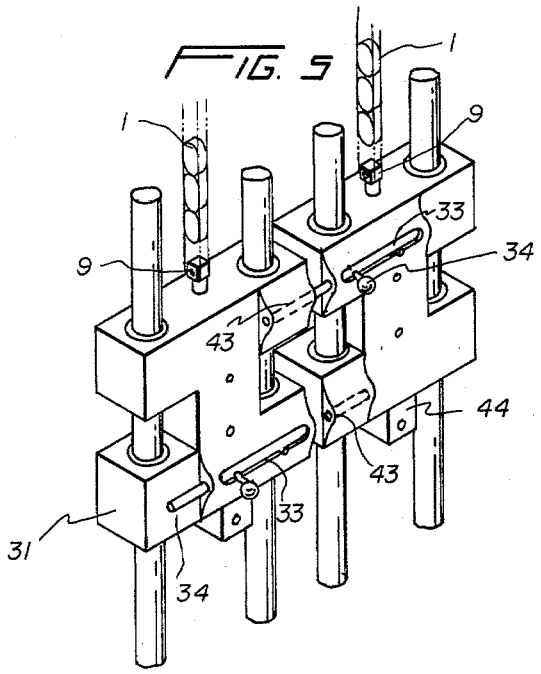
FIG. 5 shows further structural details in addition to that which is depicted in FIGS. 3 and 4.

Each I-shaped guide 31 is provided with a slidable bolt 34 constrained to ride in a trackway 33 oriented so that it may engage an eyelet 43 on an adjacent I guide (FIG. 5). For this to be possible, one of the sliding bolts 34 should be disposed upon the top portion of one I and the lower portion of the other I with their eyelets in registry so that each I guide can be united to the other when simultaneous working of both handles 25 is preferred.

Figure 4:
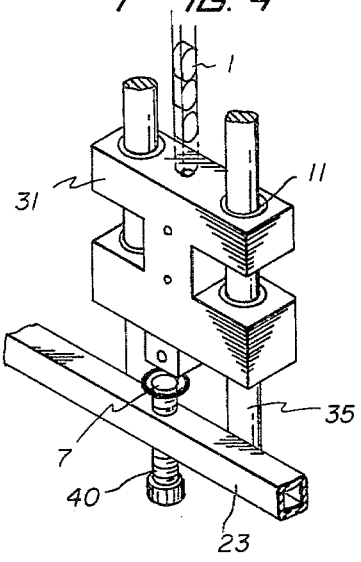
FIG. 4 shows another detail of that which is shown in FIG. 3.

U-shaped support bracket 23 is provided with a rubber stopper 7 (FIG. 4), whose vertical magnitude is relatively adjustable 40 to provide a stopper for the I guide, and the top portion of each I guide is connected through bolts 9 to a chain 1 (FIG. 5) which extends vertically upward to the top most extent of the exercise machine and over a sprocket 10 if a chain is being used instead of a cable. In the event that a cable is to be used, a simple pulley at the top most portion will suffice.

Figure 6:
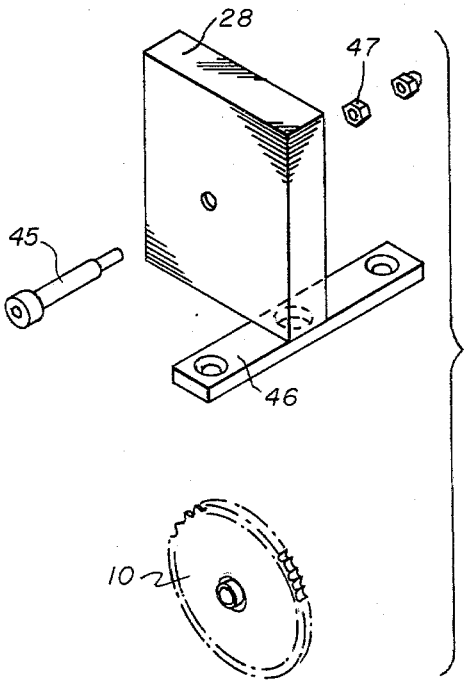
FIG. 6 shows the structural details of a shroud and sprocket associated with the structure that provides a counterbalance.

The sprocket 10 is supported on the cross bar 27 as shown in the drawing figures, and a shroud 28 serves to isolate the sprocket from the environment as well as provide the support for the sprocket itself. This is shown in FIG. 6 as being defined by a substantially rectanguloid hollow 28 having a bottom open face, and means to connect same to a flat rod member 46 which can be bolted to the cross bar 27 by an extension 29, 30 (FIG. 1) placed towards the back of the machine. The sprocket 10 is rotatably supported on an axle 45 constrained on the shroud 28 by means of nuts 47.

At this point it should be important to note that with even no weight assigned by weight plates 24, the chain near sprocket 10 has a substantial initial weight which includes the handle 25, the I guides 31, the downwardly depending rod 37 which extends into the weights, and the associated hardware which provides interconnection between all of these components. The chain 1 of course is an additional source of weight. As stated in the preamble of the specification,, these weights typically arrive at a minimum of 40 pounds which necessarily would exclude children and perhaps women as well as some men in performing certain exercises on this machine since in the absence of a counterbalance, they should be able to perform this exercise with a minimum of 40 pounds.

Chain 1 which loops over sprocket 10 is operatively connected to counterbalanced weights which effectively negates the magnitude of the weight associated with the previously detailed hardware. In FIGS. 1 and 2, this counterbalance takes the form of a cylinder 42 depending from the chain 1 on one side of sprocket 10, and this cylinder 42 is surrounded and isolated from the environment by a protective sleeve 41. The magnitude of the counterbalance weight 42 is of course selected to completely negate the aforementioned hardware which is disposed on an opposite side of the sprocket, thus providing counterbalancing.

FIGS. 7, 8, and 9 details a second form of the invention wherein counter weight rods 13 extend between the upper U-shaped frame 29 and 30 and the lower frame 32. A pair of counterbalanced weights 12 are each slidably disposed on its own pair of counter weights rods 13. The chain 1 terminates at the top face of these counterbalanced weights, and the weights themselves are slidably disposed on the rods by means of brass bushings which serve to reduce the friction. By having the counterbalance on an opposite side of the sprocket relative to the hardware counterbalancing is provided.

A chain adjuster 8 is provided to remove any slack within the chain so that there is an instantaneous reaction to work done.

Having thus described the invention, it should be apparent that the two forms of this invention comprise a single invention concept and each embodiment is merely illustrative of a way to carry out the concept of counterbalancing. Numerous structural modifications and revisions are contemplated as being a part of this invention as set forth hereinabove and as defined hereinbelow by the claims.

What is claimed is:

1. An exercise machine comprising in combination:

a framework including a base, a pair of vertically upstanding support members emanating from said base, a cross bar support connecting vertical termini of said upstanding support members remote from said base, a plurality of weights supported on said framework, the magnitude of said weights being adjustable, upper and lower U-shaped support braces connected to said support members, two pairs of guide rods disposed between said support braces, I guides slidably disposed on said guide rods, means connecting said I guides to said weights, means to move said weights in performing an exercise and fastened to said I guides, counterbalance means for negating the intrinsic weight associated with said moving means and said I guides, and chain means extending between said counterbalance means and said I guides to operatively connect said counterbalance with said moving means.

2. The device of claim 1 wherein said counterbalance means include a sprocket on said upper U-shaped support brace, and said chain means overlies said sprocket extending from said counterbalance means to said I guide.

3. The device of claim 2 in which said means to move said weights includes handle members attached to said I guides, one handle to each guide.

4. The device of claim 3 in which each of said I guides is provided with means to interconnect said I guides so that each I guide may be used separately or in unison.

5. The device of claim 3 in which said counterbalanced means comprises two pairs of counterweight rods extending between said upper and lower U-shaped support braces, and a pair of counterbalanced weights slidably disposed upon said counterweight rods, said chain means connected to said counterbalanced weights.

6. The device of claim 1 in which said counterbalance means comprises a substantially cylindrical counterbalance weight attached to said chain means and a protective sleeve fastened to said support braces and overlying said cylinder.

* * * * *